US010704287B1

(12) United States Patent
Brown et al.

(10) Patent No.: US 10,704,287 B1
(45) Date of Patent: Jul. 7, 2020

(54) INFLATABLE TENT WITH AIR MATTRESS

(71) Applicants: Bettina Brown, Pembroke Pines, FL (US); Keith Wasserman, Pembroke Pines, FL (US)

(72) Inventors: Bettina Brown, Pembroke Pines, FL (US); Keith Wasserman, Pembroke Pines, FL (US)

( * ) Notice: Subject to any disclaimer, the term of this patent is extended or adjusted under 35 U.S.C. 154(b) by 0 days.

(21) Appl. No.: 16/196,010

(22) Filed: Nov. 20, 2018

(51) Int. Cl.
*E04H 15/20* (2006.01)
*A47C 27/08* (2006.01)

(52) U.S. Cl.
CPC ..... *E04H 15/20* (2013.01); *A47C 27/083* (2013.01); *A47C 27/084* (2013.01); *E04H 2015/201* (2013.01); *E04H 2015/206* (2013.01); *E04H 2015/208* (2013.01)

(58) Field of Classification Search
CPC ..... E04H 15/20; E04H 2015/201; E04H 2015/206; E04H 2015/208; E04H 15/324; E04H 15/42; E04H 15/425; E04H 2015/204
See application file for complete search history.

(56) References Cited

U.S. PATENT DOCUMENTS 4,819,389 A * 4/1989 Kihn ..... E04H 15/20 135/97
4,876,829 A 10/1989 Mattick
4,901,481 A * 2/1990 Seeley, Jr. ..... E04H 15/20 52/2.15
5,005,322 A * 4/1991 Mattick ..... E04H 15/20 52/25
5,007,212 A 4/1991 Fritts
5,487,400 A 1/1996 Dawkins
5,642,750 A * 7/1997 Brown ..... E04H 15/20 135/116
5,660,197 A * 8/1997 Boe ..... A47C 27/081 135/116
5,913,322 A 6/1999 Gallant
6,167,898 B1 1/2001 Larga
6,192,633 B1 2/2001 Hilbert
6,263,617 B1 7/2001 Turcot
6,722,084 B2 4/2004 Berman
D510,118 S 9/2005 Smith
8,166,711 B2 5/2012 Lamke
2003/0213512 A1* 11/2003 Lee ..... E04H 15/20 135/126

(Continued)

FOREIGN PATENT DOCUMENTS

WO 2008095295 8/2008

*Primary Examiner* — Gisele D Ford

(57) ABSTRACT

The inflatable tent with air mattress is an inflatable shelter. The inflatable tent with air mattress comprises a quadric shelter and a base sheeting. The quadric shelter attaches to the base sheeting to form an enclosed interior space that serves as the shelter. The base sheeting is a fluid impermeable sheeting that forms a barrier between the ground and the enclosed interior space formed by the inflatable tent with air mattress. The quadric shelter is an inflatable structure. When inflated, the quadric shelter expands away from the base sheeting to form the enclosed interior spaces of the inflatable tent with air mattress The quadric shelter forms a liquid impermeable barrier that forms the superior surface of the inflatable tent with air mattress.

7 Claims, 4 Drawing Sheets

(56) References Cited

U.S. PATENT DOCUMENTS

| | | | | |
|---|---|---|---|---|
| 2009/0300993 | A1* | 12/2009 | Lamke | E04H 15/20<br>52/2.18 |
| 2019/0010725 | A1* | 1/2019 | Bueno | E04H 15/20 |
| 2019/0128011 | A1* | 5/2019 | Derbes | E04H 15/20 |

* cited by examiner

INFLATABLE TENT WITH AIR MATTRESS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of building including tents and canopies, more specifically, an inflatable tent. (E04H2015/201)

SUMMARY OF INVENTION

The inflatable tent with air mattress is an inflatable shelter. The inflatable tent with air mattress comprises a quadric shelter and a base sheeting. The quadric shelter attaches to the base sheeting to form an enclosed interior space that serves as the shelter. The base sheeting is a fluid impermeable sheeting that forms a barrier between the ground and the enclosed interior space formed by the inflatable tent with air mattress. The quadric shelter is an inflatable structure. When inflated, the quadric shelter expands away from the base sheeting to form the enclosed interior spaces of the inflatable tent with air mattress The quadric shelter forms a liquid impermeable barrier that forms the superior surface of the inflatable tent with air mattress.

These together with additional objects, features and advantages of the inflatable tent with air mattress will be readily apparent to those of ordinary skill in the art upon reading the following detailed description of the presently preferred, but nonetheless illustrative, embodiments when taken in conjunction with the accompanying drawings.

In this respect, before explaining the current embodiments of the inflatable tent with air mattress in detail, it is to be understood that the inflatable tent with air mattress is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the inflatable tent with air mattress.

It is therefore important that the claims be regarded as including such equivalent construction insofar as they do not depart from the spirit and scope of the inflatable tent with air mattress. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
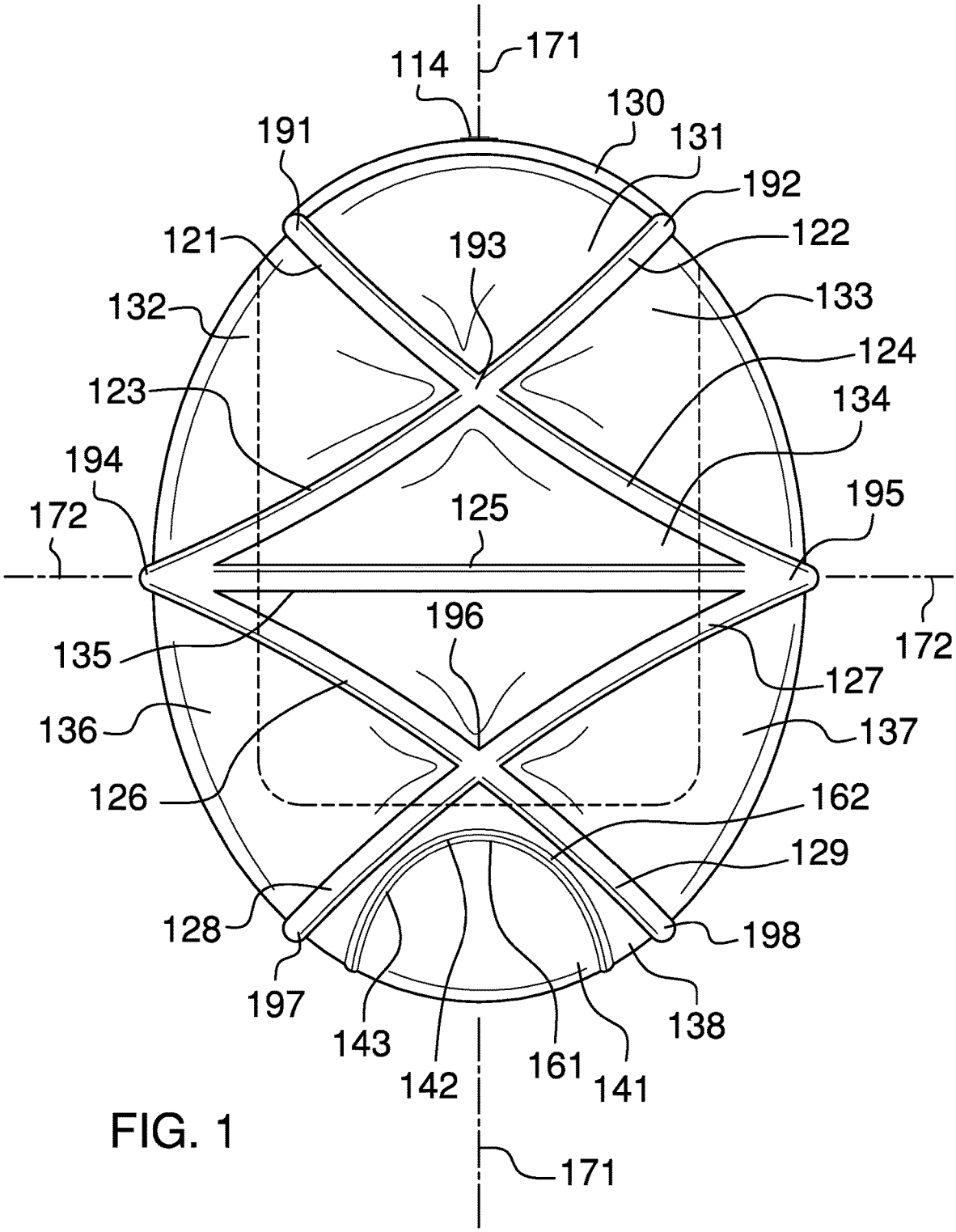
FIG. 1 is a top view of an embodiment of the disclosure.
Figure 2:
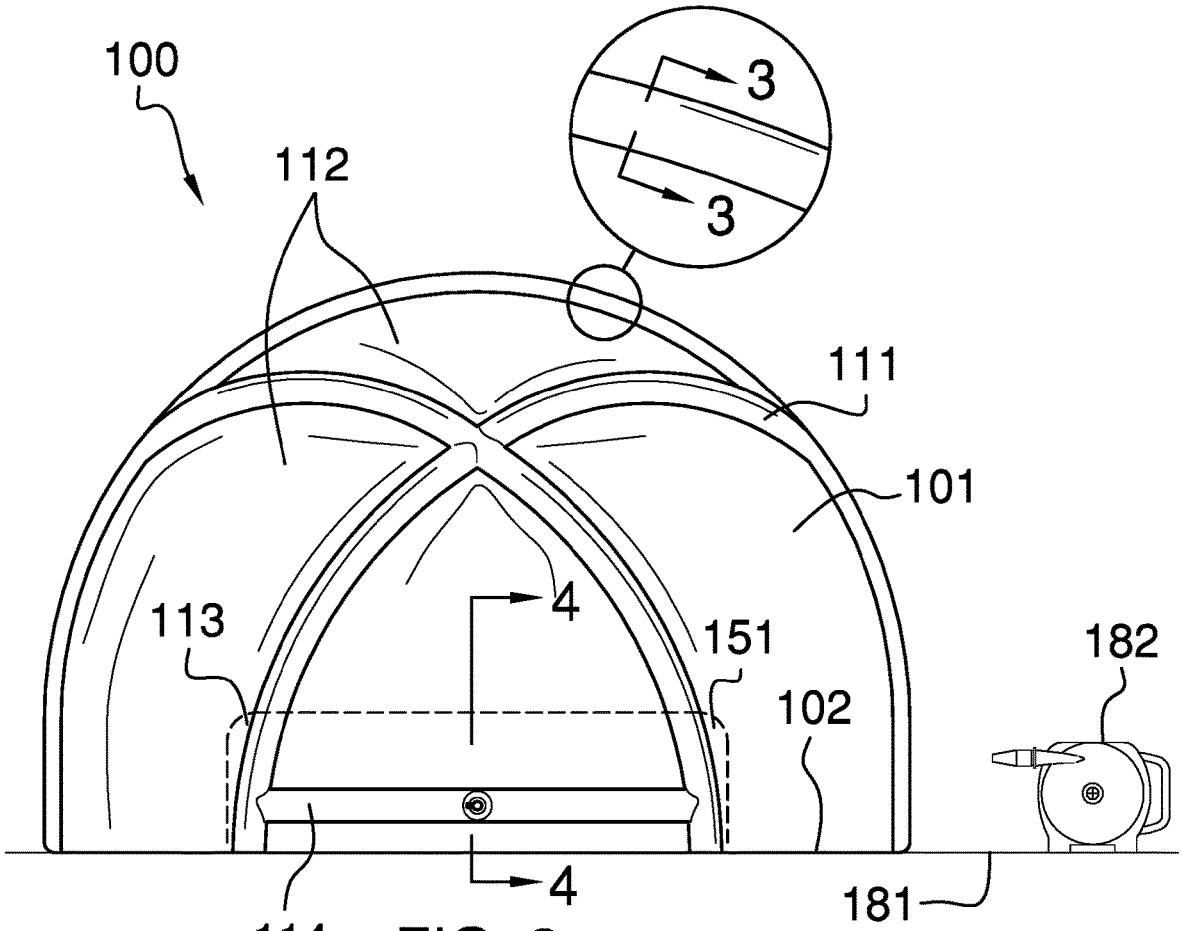
FIG. 2 is a rear view of an embodiment of the disclosure.
Figure 3:
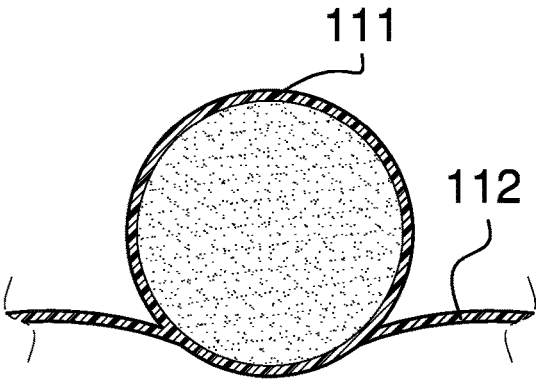
FIG. 3 is a cross-sectional view of an embodiment of the disclosure across 3-3 as shown in FIG. 2.
Figure 4:
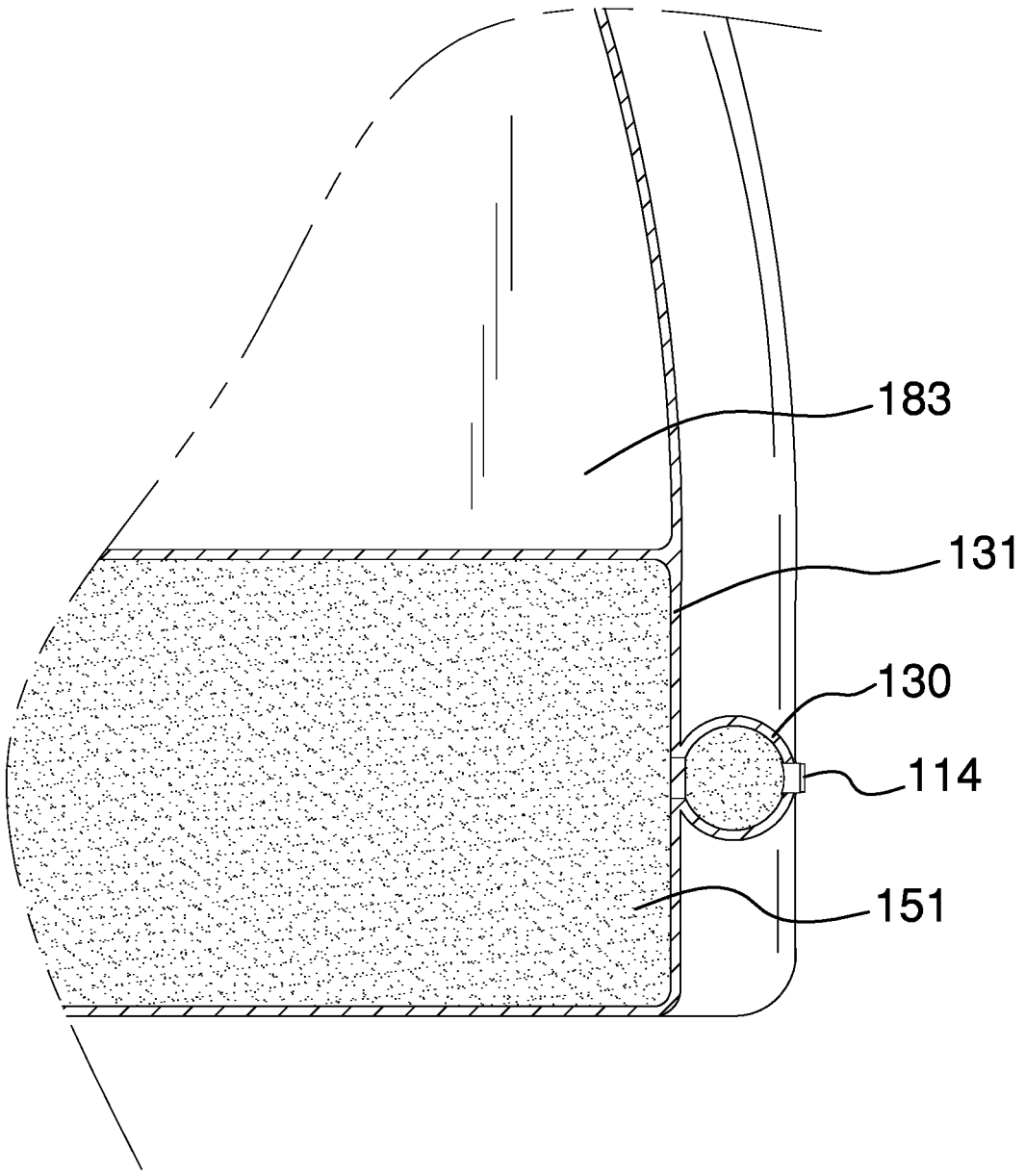
FIG. 4 is a cross-sectional view of an embodiment of the disclosure across 4-4 as shown in FIG. 2.
Figure 5:
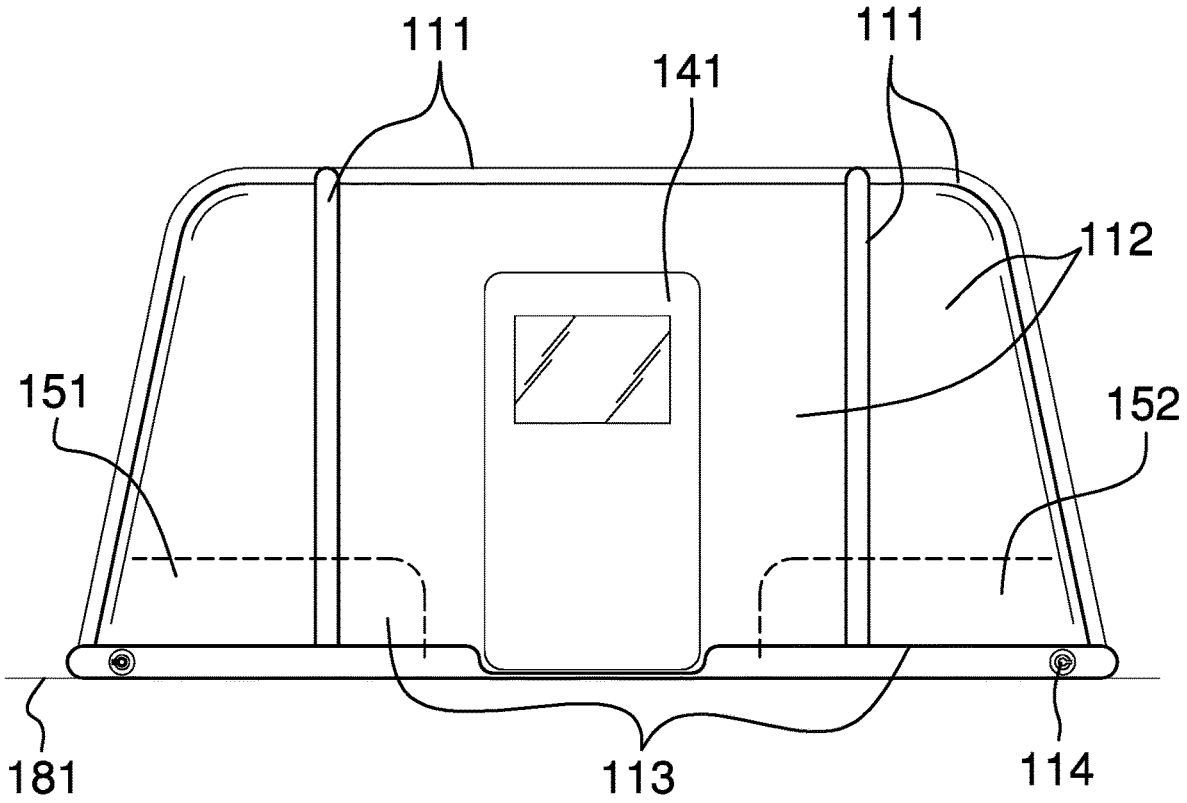
FIG. 5 is a front view of an embodiment of the disclosure.

Detailed reference will now be made to one or more potential embodiments of the disclosure, which are illustrated in FIGS. 1 through 5.

The inflatable tent with air mattress 100 (hereinafter invention) is an inflatable shelter. The invention 100 comprises a quadric shelter 101 and a base sheeting 102. The quadric shelter 101 attaches to the base sheeting 102 to form an enclosed interior space 183 that serves as the shelter. The base sheeting 102 is a fluid impermeable sheeting that forms a barrier between the ground 181 and the enclosed interior space 183 formed by the invention 100. The quadric shelter 101 is an inflatable structure. When inflated, the quadric shelter 101 expands away from the base sheeting 102 to form the enclosed interior space 183 of the invention 100 The quadric shelter 101 forms a liquid impermeable barrier that forms the superior surface of the invention 100. The ground 181 is defined elsewhere in this disclosure.

The base sheeting 102 is a sheeting. The base sheeting 102 is formed from a liquid impermeable sheeting. The form factor of the base sheeting 102 is selected such that the perimeter of the base sheeting 102 is geometrically identical to the perimeter of the quadric shelter 101 when the quadric shelter 101 is inflated. The base sheeting 102 is further defined with a major axis 171 and a minor axis 172. The major axis 171 is defined elsewhere in this disclosure. The minor axis 172 is defined elsewhere in this disclosure.

The quadric shelter 101 is an inflatable structure. The quadric shelter 101 attaches to the base sheeting 102. The quadric shelter 101 forms a liquid impermeable barrier that forms the superior surface of the invention 100. The quadric shelter 101 is a self-erecting structure. The quadric shelter 101 forms a quadric surface when the quadric shelter 101 is inflated. The inflated quadric shelter 101 forms a three-dimensional structure that forms a sheltering space between the quadric shelter 101 and the base sheeting 102. The quadric shelter 101 comprises an inflatable openwork 111, a plurality of membranes 112, one or more mattresses 113, and a valve 114.

The inflatable openwork 111 forms an openwork framework. The inflatable openwork 111 forms the structure of the quadric shelter 101 that inflates into the three-dimensional structure that forms the enclosed interior space 183 of the invention 100. The inflatable openwork 111 is formed as a single structure. The inflatable openwork 111 is a self-erecting structure. The inflatable openwork 111 is formed from a fluid impermeable material.

The inflatable openwork 111 is organized into a plurality of inflatable segments. Each of the plurality of inflatable segments forms a portion of the perimeter of the open spaces formed throughout the inflatable openwork 111. Each of the plurality of inflatable segments are fluidically interconnected.

The inflatable openwork 111 comprises a first inflatable segment 121, a second inflatable segment 122, a third inflatable segment 123, a fourth inflatable segment 124, a fifth inflatable segment 125, a sixth inflatable segment 126, a seventh inflatable segment 127, an eighth inflatable segment 128, a ninth inflatable segment 129, and a tenth inflatable segment 130.

The tenth inflatable segment 130 further comprises a valve 114. The valve 114 is a fluidic connection installed in the inflatable openwork 111. The valve 114 is a fitting adapted for use with the pump 182. The valve 114 received compressed air from the pump 182 such that the compressed air inflates both the inflatable openwork 111 and the one or more mattresses 113. The pump 182 is a compressor. The pump 182 is defined elsewhere in this disclosure.

The plurality of membranes 112 comprises a collection of liquid impermeable sheetings. Each of the plurality of membranes 112 attaches to one or more edges selected from the group consisting of the inflatable openwork 111 and the base sheeting 102. The plurality of membranes 112 encloses an opening formed within the inflatable openwork 111 such that the quadric shelter 101 forms a weather protection shelter. The plurality of membranes 112 comprises a first membrane 131, a second membrane 132, a third membrane 133, a fourth membrane 134, a fifth membrane 135, a sixth membrane 136, a seventh membrane 137, and an eighth membrane 138.

The first membrane 131 is a fluid impermeable sheeting. The second membrane 132 is a fluid impermeable sheeting. The third membrane 133 is a fluid impermeable sheeting. The fourth membrane 134 is a fluid impermeable sheeting. The fifth membrane 135 is a fluid impermeable sheeting. The sixth membrane 136 is a fluid impermeable sheeting. The seventh membrane 137 is a fluid impermeable sheeting. The eighth membrane 138 is a fluid impermeable sheeting.

The eighth membrane 138 further comprises a door 141. The door 141 further comprises a slit 142 and a zipper 143. The slit 142 further comprises a first raw edge 161 and a second raw edge 162.

The door 141 is an opening that is formed in the eighth membrane 138. The door 141 forms a port that allows access into and out of the enclosed interior space 183 of the invention 100. The slit 142 is a cut that is formed through eighth membrane 138. The slit 142 forms the opening that allows access into the enclosed interior space 183 of the invention 100. The zipper 143 is a well-known and documented fastening device. The zipper 143 attaches the first raw edge 161 to the second raw edge 162. The first raw edge 161 is defined elsewhere in this disclosure. The second raw edge 162 is defined elsewhere in this disclosure.

Each of the one or more mattresses 113 is an inflatable bladder. Each of the one or more mattresses 113 attaches to the base sheeting 102 such that the one or more mattresses 113 are contained within the enclosed interior space 183 of the quadric shelter 101. The one or more mattresses 113 forms a cushion. The one or more mattresses 113 forms a fluidic connection with the inflatable openwork 111. In the first potential embodiment of the disclosure, the one or more mattresses 113 comprises a first mattress 151. In a second potential embodiment of the disclosure, the one or more mattresses 113 comprises the first mattress 151 and a second mattress 152.

The following fifteen paragraphs describe the assembly of the invention 100.

The tenth inflatable segment 130 attaches to the perimeter of the base sheeting 102 such that the major axis 171 of the base sheeting 102 passes through the center of the tenth inflatable segment 130 when the tenth inflatable segment 130 is deflated. The tenth inflatable segment 130 forms a fluidic connection with each of the one or more mattresses 113 such that the inflation of the tenth inflatable segment 130 inflates each of the one or more mattresses 113.

A first junction 191 forms a fluidic connection between the first inflatable segment 121 and the tenth inflatable segment 130. The first junction 191 attaches to the perimeter of the base sheeting 102. A second junction 192 forms a fluidic connection between the second inflatable segment 122 and the tenth inflatable segment 130. The second junction 192 attaches to the perimeter of the base sheeting 102. A third junction 193 forms a fluidic connection between the first inflatable segment 121, the second inflatable segment 122, the third inflatable segment 123, and the fourth inflatable segment 124. The third junction 193 is free standing. A fourth junction 194 forms a fluidic connection between the third inflatable segment 123, the fifth inflatable segment 125, and the sixth inflatable segment 126. The fourth junction 194 attaches to the perimeter of the base sheeting 102.

A fifth junction 195 forms a fluidic connection between the fourth inflatable segment 124, the fifth inflatable segment 125, and the seventh inflatable segment 127. The fifth junction 195 attaches to the perimeter of the base sheeting 102. A sixth junction 196 forms a fluidic connection between the sixth inflatable segment 126, the seventh inflatable segment 127, the eighth inflatable segment 128, and the ninth inflatable segment 129. The sixth junction 196 is free standing. A seventh junction 197 attaches the eighth inflatable segment 128 to the perimeter of the base sheeting 102 to form a fluid impermeable seal. An eighth junction 198 attaches the ninth inflatable segment 129 to the perimeter of the base sheeting 102 to form a fluid impermeable seal.

The first membrane 131 attaches to the inflatable openwork 111 such that the first membrane 131 encloses an opening formed in the inflatable openwork 111. The first membrane 131 encloses the opening bounded by the perimeter formed by the first inflatable segment 121, the second inflatable segment 122, and the tenth inflatable segment 130.

The second membrane 132 attaches to the inflatable openwork 111 such that the second membrane 132 encloses an opening formed in the inflatable openwork 111. The second membrane 132 encloses the opening bounded by the perimeter formed by the first inflatable segment 121, the third inflatable segment 123, and the base sheeting 102. The second membrane 132 attaches to the base sheeting 102 to form a fluid impermeable seal.

The third membrane 133 attaches to the inflatable openwork 111 such that the third membrane 133 encloses an opening formed in the inflatable openwork 111. The third membrane 133 encloses the opening bounded by the perimeter formed by the second inflatable segment 122, the fourth inflatable segment 124, and the base sheeting 102. The third membrane 133 attaches to the base sheeting 102 to form a fluid impermeable seal.

The fourth membrane 134 attaches to the inflatable openwork 111 such that the fourth membrane 134 encloses an opening formed in the inflatable openwork 111. The fourth membrane 134 encloses the opening bounded by the perimeter formed by the third inflatable segment 123, the fourth inflatable segment 124, and the fifth inflatable segment 125.

The fifth membrane 135 attaches to the inflatable openwork 111 such that the fifth membrane 135 encloses an opening formed in the inflatable openwork 111. The fifth membrane 135 encloses the opening bounded by the perimeter formed by the fifth inflatable segment 125, the sixth inflatable segment 126, and the seventh inflatable segment 127.

The sixth membrane 136 attaches to the inflatable openwork 111 such that the sixth membrane 136 encloses an opening formed in the inflatable openwork 111. The sixth membrane 136 encloses the opening bounded by the perimeter formed by the sixth inflatable segment 126, the eighth inflatable segment 128, and the base sheeting 102. The sixth membrane 136 attaches to the base sheeting 102 to form a fluid impermeable seal.

The seventh membrane 137 attaches to the inflatable openwork 111 such that the seventh membrane 137 encloses an opening formed in the inflatable openwork 111. The seventh membrane 137 encloses the opening bounded by the perimeter formed by the seventh inflatable segment 127, the ninth inflatable segment 129, and the base sheeting 102. The seventh membrane 137 attaches to the base sheeting 102 to form a fluid impermeable seal.

The eighth membrane 138 attaches to the inflatable openwork 111 such that the eighth membrane 138 encloses an opening formed in the inflatable openwork 111. The eighth membrane 138 encloses the opening bounded by the perimeter formed by the eighth inflatable segment 128, the ninth inflatable segment 129, and the base sheeting 102. The eighth membrane 138 attaches to the base sheeting 102 to form a fluid impermeable seal.

The tenth inflatable segment 130 attaches to the base sheeting 102 such that the span of the distance of the first junction 191 from the major axis 171 equals the span of the distance of the second junction 192 from the major axis 171. The seventh junction 197 and the eighth junction 198 each attach to the perimeter of the base sheeting 102 such that the span of the distance from the point where the major axis 171 intersects the perimeter of the base sheeting 102 to the seventh junction 197 equals the span of the distance from the point where the major axis 171 intersects the perimeter of the base sheeting 102 and the eighth junction 198.

The fourth junction 194 attaches to the perimeter of the base sheeting 102 at the point where the minor axis 172 of the base sheeting 102 intersects the perimeter of the base sheeting 102. The fifth junction 195 attaches to the perimeter of the base sheeting 102 at the point where the minor axis 172 of the base sheeting 102 intersects the perimeter of the base sheeting 102.

The door 141 is formed by cutting the slit 142 in the eighth membrane 138 such that the slit 142 does not bifurcate the perimeter of the eighth membrane 138. The zipper 143 attaches the first raw edge 161 of the slit 142 to the second raw edge 162 of the slit 142 such that the opening formed by the slit 142 can open and close.

The valve 114 installs in the tenth inflatable segment 130 such that the pump 182 can access the valve 114 from the exterior of the invention 100.

The following definitions were used in this disclosure:

Bifurcate: As used in this disclosure, to bifurcate means to divide an object or space into two pieces or segments.

Bladder: As used in this disclosure, a bladder is gas impermeable structure. The internal volume of the structure can be varied by: varying the pressure and/or quantity of a gas contained within the bladder; or 2) varying the quantity of a liquid contained within the bladder. Bladders are commonly used for storage of a gas or liquid and as a cushion.

Correspond: As used in this disclosure, the term correspond is used as a comparison between two or more objects wherein one or more properties shared by the two or more objects match, agree, or align within acceptable manufacturing tolerances.

Cushion: As used in this disclosure a cushion is a pad or pillow formed from soft material used for resting, sleeping, or reclining.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Force of Gravity: As used in this disclosure, the force of gravity refers to a vector that indicates the direction of the pull of gravity on an object at or near the surface of the earth.

Framework: As used in this disclosure, a framework refers to the substructure of an object that carries the load path of the object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. Always use Correspond and One to One Ground: As used in this disclosure, the ground is a solid supporting surface formed by the Earth. The term level ground means that the supporting surface formed by the ground is roughly perpendicular to the force of gravity.

Inferior: As used in this disclosure, the term inferior refers to a directional reference that is parallel to and in the same direction as the force of gravity when an object is positioned or used normally.

Inflation: As used in this disclosure, inflation refers to filling the interior of an enclosed fluid impermeable semi-rigid structure with gas at a pressure greater than exterior gas pressure of the enclosed fluid impermeable semi-rigid structure.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Major and Minor Axes: As used in this disclosure, the major and minor axes refer to a pair of perpendicular axes that are defined within a structure. The length of the major axis is always greater than or equal to the length of the minor axis. The major axis is always the longest diameter of the structure. The major and minor axes intersect at the center of the structure. The major axis is always parallel to an edge of a rectangular or rectilinear structure.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Openwork: As used in this disclosure, the term open work is used to describe a structure, often a surface, which is formed with openings that allow for visibility and fluid flow through the structure. Wrought work and meshes are forms of openwork.

Pressure: As used in this disclosure, pressure refers to a measure of force per unit area.

Pump: As used in this disclosure, a pump is a mechanical device that uses suction or pressure to raise or move fluids, compress fluids, or force a fluid into an inflatable object. Within this disclosure, a compressor refers to a pump dedicated to compressing a fluid or placing a fluid under pressure.

Quadric Bifurcation: As used in this disclosure, a quadric bifurcation refers either one of the two objects formed by the bifurcation of a quadric surface by a bifurcating plane that is parallel to a major or minor axis of the structure formed by quadric surface.

Quadric Surface: As used in this disclosure, a quadric surface is a three-dimensional surface that varies in the three Cartesian coordinates in an algebraically defined manner that is related to conic sections. Euclidian planes as well as the surfaces of ellipsoids, spheres, paraboloids, and cones are examples of quadric surfaces. The Euclidian plane is technically considered a degenerate form of a quadric surface but, unless specifically stated otherwise within this disclosure, is explicitly included in this definition. Quadric surfaces are described by the general algebraic form: $Ax^2+By^2+Cz^2+Dxy+Exz+Fyz+Gx+Hy+Iz+J=0$.

Raw Edge: As used in this disclosure, a raw edge refers to one of two edges that are formed when a sheeting is cut through the face of the sheeting. The one or more ends of the slit are called the termination points.

Sheeting: As used in this disclosure, a sheeting is a material, such as a paper, textile, a plastic, or a metal foil, in the form of a thin flexible layer or layers.

Shelter: As used in this disclosure, a shelter is a structure that forms a space used for protection against potentially harmful situations. The term shelter is commonly used for structures that protect against the weather.

Slit: As used in this disclosure, a slit is a long narrow cut or opening that is formed in or through an object. Textile: As used in this disclosure, a textile is a material that is woven, knitted, braided or felted. Synonyms in common usage for this definition include fabric and cloth.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Tube: As used in this disclosure, a tube is a hollow prism-shaped device formed with two open ends. The tube is used for transporting liquids and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Valve: As used in this disclosure, a valve is a device that is used to control the flow of a fluid (gas or liquid) through a structure.

Weather: As used in this disclosure, the term weather refers to a collection of measurable parameters of the atmosphere including, but not limited to, temperature, humidity, precipitation, air movement caused by wind and energy and illumination from the sun. A structure that isolates an individual or object from the more uncomfortable or destructive aspects of the weather is said to provide protection against the weather. The term elements is often used to refer to weather.

Zipper: As used in this disclosure, a zipper is a fastening device comprising a first chain tape, a second chain tape, and a zipper pull. The first chain tape and the second chain tape are textile webbings formed with interlocking components that form a chain. The chain opened and closed by pulling a slide, called a zipper pull, over the first chain tape, a second chain tape. The individual elements of the chain are called the teeth of the chain.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An inflatable shelter comprising:

a quadric shelter and a base sheeting;

wherein the quadric shelter attaches to the base sheeting;
wherein the quadric shelter and the base sheeting form an enclosed interior space;
wherein the base sheeting rests on the ground;
wherein the base sheeting forms a barrier between the ground and the enclosed interior space;
wherein the quadric shelter is an inflatable structure;
wherein the quadric shelter expands away from the base sheeting to form the enclosed interior space;
wherein the quadric shelter forms a liquid impermeable barrier that forms the superior surface of the inflatable shelter;
wherein the base sheeting is a fluid impermeable sheeting;
wherein the base sheeting is formed from a liquid impermeable sheeting;
wherein the form factor of the base sheeting is selected such that the perimeter of the base sheeting is geometrically identical to the perimeter of the quadric shelter when the quadric shelter is inflated;
wherein the base sheeting is further defined with a major axis and a minor axis;
wherein the quadric shelter is a self-erecting structure;
wherein the quadric shelter forms a quadric surface when the quadric shelter is inflated;
wherein the inflated quadric shelter forms a three-dimensional structure that forms the enclosed interior space between the quadric shelter and the base sheeting;
wherein the quadric shelter comprises an inflatable openwork, a plurality of membranes, one or more mattresses, and a valve;
wherein the plurality of membranes attach to the inflatable openwork;
wherein the inflatable openwork, the one or more mattresses, and the valve are fluidically interconnected;
wherein the inflatable openwork forms an openwork framework;
wherein the inflatable openwork forms the structure of the quadric shelter that inflates into the three-dimensional structure that forms the enclosed interior space of the inflatable shelter;
wherein the inflatable openwork comprises a first inflatable segment, a second inflatable segment, a third inflatable segment, a fourth inflatable segment, a fifth inflatable segment, a sixth inflatable segment, a seventh inflatable segment, an eighth inflatable segment, a ninth inflatable segment, and a tenth inflatable segment;
wherein the first inflatable segment, the second inflatable segment, the third inflatable segment, the fourth inflatable segment, the fifth inflatable segment, the sixth inflatable segment, the seventh inflatable segment, the eighth inflatable segment, the ninth inflatable segment, and the tenth inflatable segment are fluidically interconnected;
wherein the plurality of membranes comprises a collection of liquid impermeable sheetings;
wherein each of the plurality of membranes attaches to one or more edges selected from the group consisting of the inflatable openwork and the base sheeting;
wherein the plurality of membranes encloses an opening formed within the inflatable openwork;
wherein the plurality of membranes comprises a first membrane, a second membrane, a third membrane, a fourth membrane, a fifth membrane, a sixth membrane, a seventh membrane, and an eighth membrane;
wherein the first membrane is a fluid impermeable sheeting;
wherein the second membrane is a fluid impermeable sheeting;
wherein the third membrane is a fluid impermeable sheeting;
wherein the fourth membrane is a fluid impermeable sheeting;
wherein the fifth membrane is a fluid impermeable sheeting;
wherein the sixth membrane is a fluid impermeable sheeting;
wherein the seventh membrane is a fluid impermeable sheeting;
wherein the eighth membrane is a fluid impermeable sheeting;
wherein each of the one or more mattresses is an inflatable bladder;
wherein each of the one or more mattresses attaches to the base sheeting such that the one or more mattresses are contained within the enclosed interior space of the quadric shelter;
wherein each of the one or more mattresses forms a cushion;
wherein the one or more mattresses forms a fluidic connection with the inflatable openwork;
wherein the tenth inflatable segment further comprises a valve;
wherein the valve is a fluidic connection installed in the inflatable openwork;
wherein the valve is a fitting adapted for use with a pump;
wherein the valve receives compressed air from the pump such that the compressed air inflates both the inflatable openwork and the one or more mattresses
wherein the eighth membrane further comprises a door;
wherein the door further comprises a slit and a zipper;
wherein the slit further comprises a first raw edge and a second raw edge;
wherein the slit forms the opening that allows access into the enclosed interior space of the inflatable shelter;
wherein the tenth inflatable segment attaches to the perimeter of the base sheeting such that the major axis of the base sheeting passes through the center of the tenth inflatable segment when the tenth inflatable segment is deflated;
wherein the tenth inflatable segment forms a fluidic connection with each of the one or more mattresses such that the inflation of the tenth inflatable segment inflates each of the one or more mattresses;
wherein a first junction forms a fluidic connection between the first inflatable segment and the tenth inflatable segment;
wherein the first junction attaches to the perimeter of the base sheeting;
wherein a second junction forms a fluidic connection between the second inflatable segment and the tenth inflatable segment;
wherein the second junction attaches to the perimeter of the base sheeting;
wherein a third junction forms a fluidic connection between the first inflatable segment, the second inflatable segment, the third inflatable segment, and the fourth inflatable segment;
wherein a fourth junction forms a fluidic connection between the third inflatable segment, the fifth inflatable segment, and the sixth inflatable segment;
wherein the fourth junction attaches to the perimeter of the base sheeting;

wherein a fifth junction forms a fluidic connection between the fourth inflatable segment, the fifth inflatable segment, and the seventh inflatable segment;

wherein the fifth junction attaches to the perimeter of the base sheeting;

wherein a sixth junction forms a fluidic connection between the sixth inflatable segment, the seventh inflatable segment, the eighth inflatable segment, and the ninth inflatable segment;

wherein a seventh junction attaches the eighth inflatable segment to the perimeter of the base sheeting to form a fluid impermeable seal;

wherein an eighth junction attaches the ninth inflatable segment to the perimeter of the base sheeting to form a fluid impermeable seal.

2. The inflatable shelter according to claim 1 wherein the inflatable openwork is formed as a single structure;

wherein the inflatable openwork is a self-erecting structure;

wherein the inflatable openwork is formed from a fluid impermeable material.

3. The inflatable shelter according to claim 1 wherein the first membrane attaches to the inflatable openwork such that the first membrane encloses an opening formed in the inflatable openwork;

wherein the first membrane encloses the opening bounded by the perimeter formed by the first inflatable segment, the second inflatable segment, and the tenth inflatable segment;

wherein the second membrane attaches to the inflatable openwork such that the second membrane encloses an opening formed in the inflatable openwork;

wherein the second membrane encloses the opening bounded by the perimeter formed by the first inflatable segment, the third inflatable segment, and the base sheeting;

wherein the second membrane attaches to the base sheeting to form a fluid impermeable seal;

wherein the third membrane attaches to the inflatable openwork such that the third membrane encloses an opening formed in the inflatable openwork;

wherein the third membrane encloses the opening bounded by the perimeter formed by the second inflatable segment, the fourth inflatable segment, and the base sheeting;

wherein the third membrane attaches to the base sheeting to form a fluid impermeable seal;

wherein the fourth membrane attaches to the inflatable openwork such that the fourth membrane encloses an opening formed in the inflatable openwork;

wherein the fourth membrane encloses the opening bounded by the perimeter formed by the third inflatable segment, the fourth inflatable segment, and the fifth inflatable segment;

wherein the fifth membrane attaches to the inflatable openwork such that the fifth membrane encloses an opening formed in the inflatable openwork;

wherein the fifth membrane encloses the opening bounded by the perimeter formed by the fifth inflatable segment, the sixth inflatable segment, and the seventh inflatable segment;

wherein the sixth membrane attaches to the inflatable openwork such that the sixth membrane encloses an opening formed in the inflatable openwork;

wherein the sixth membrane encloses the opening bounded by the perimeter formed by the sixth inflatable segment, the eighth inflatable segment, and the base sheeting;

wherein the sixth membrane attaches to the base sheeting to form a fluid impermeable seal;

wherein the seventh membrane attaches to the inflatable openwork such that the seventh membrane encloses an opening formed in the inflatable openwork;

wherein the seventh membrane encloses the opening bounded by the perimeter formed by the seventh inflatable segment, the ninth inflatable segment, and the base sheeting;

wherein the seventh membrane attaches to the base sheeting to form a fluid impermeable seal;

wherein the eighth membrane attaches to the inflatable openwork such that the eighth membrane encloses an opening formed in the inflatable openwork;

wherein the eighth membrane encloses the opening bounded by the perimeter formed by the eighth inflatable segment, the ninth inflatable segment, and the base sheeting;

wherein the eighth membrane attaches to the base sheeting to form a fluid impermeable seal;

wherein the tenth inflatable segment attaches to the base sheeting such that the span of the distance of the first junction from the major axis equals the span of the distance of the second junction from the major axis;

wherein the seventh junction and the eighth junction each attach to the perimeter of the base sheeting such that the span of the distance from the point where the major axis intersects the perimeter of the base sheeting to the seventh junction equals the span of the distance from the point where the major axis intersects the perimeter of the base sheeting and the eighth junction;

wherein the fourth junction attaches to the perimeter of the base sheeting at the point where the minor axis of the base sheeting intersects the perimeter of the base sheeting;

wherein the fifth junction attaches to the perimeter of the base sheeting at the point where the minor axis of the base sheeting intersects the perimeter of the base sheeting.

4. The inflatable shelter according to claim 3 wherein the door is formed by cutting the slit in the eighth membrane such that the slit does not bifurcate the perimeter of the eighth membrane.

5. The inflatable shelter according to claim 4 wherein the valve installs in the tenth inflatable segment such that the pump can access the valve from the exterior of the inflatable shelter.

6. The inflatable shelter according to claim 5 wherein the one or more mattresses comprises a first mattress.

7. The inflatable shelter according to claim 6 wherein the one or more mattresses comprises a first mattress and a second mattress.

* * * * *